US005172126A

United States Patent [19]

Naito

[11] Patent Number: 5,172,126

[45] Date of Patent: Dec. 15, 1992

[54] LOW NOISE LUMPED PARAMETER ACTIVE RECEIVING ANTENNA

[75] Inventor: Michiko Naito, Tokorozawa, Japan

[73] Assignee: Kabushiki Kaisha ENU ESU, Tokyo, Japan

[21] Appl. No.: 477,868

[22] PCT Filed: Aug. 7, 1989

[86] PCT No.: PCT/JP89/00806

§ 371 Date: Apr. 9, 1990

§ 102(e) Date: Apr. 9, 1990

[87] PCT Pub. No.: WO90/01814

PCT Pub. Date: Feb. 22, 1990

[30] Foreign Application Priority Data

Aug. 12, 1988 [JP] Japan ..... 63-200211

[51] Int. Cl.[5] ..... H01Q 1/26

[52] U.S. Cl. ..... 343/701; 343/749

[58] Field of Search ..... 343/701, 749; 455/293, 455/291, 341

[56] References Cited

U.S. PATENT DOCUMENTS

| | | | |
|---|---|---|---|
| 2,977,551 | 3/1961 | Gibson et al. | 343/701 |
| 3,386,033 | 5/1968 | Copeland et al. | 343/701 |
| 3,703,685 | 11/1972 | Simopoulos et al. | 343/701 |
| 3,714,659 | 1/1973 | Firman | 343/701 |
| 3,774,218 | 11/1973 | Fowler | 343/701 |
| 4,115,778 | 9/1978 | Snow | 343/701 |
| 5,019,830 | 5/1991 | Harada | 343/701 |

OTHER PUBLICATIONS

Tooley et al.; "Active Receiving Antenna", Practical Wireless, Mar. 1981, vol. 57, No. 3, pp. 52–56.

*Primary Examiner*—Rolf Hille
*Assistant Examiner*—Hoanganh Le
*Attorney, Agent, or Firm*—Lowe, Price, LeBlanc & Becker

[57] ABSTRACT

A small, relatively wide-bandwidth, active antenna is usable in a wide range of applications spanning the VLF and SHF bands. The antenna is capable of receiving relatively weak radio frequency signals having a signal strength below that detectable using conventional passive antennas. The antenna includes a lumped constant element forming an electric wave receiving part, and a high impedence amplifier having input terminals connected via leads having a short electrical wavelength at the design frequency, to corresponding ends of the lumped constant element. Output terminals of the antenna are connected to a receiver to provide a small, high sensitivity, active antenna.

7 Claims, 4 Drawing Sheets

LOW NOISE LUMPED PARAMETER ACTIVE RECEIVING ANTENNA

TECHNICAL FIELD

The present invention relates to active antennas, and more particularly to small superhigh sensitivity active antennas usable in a wide range of applications ranging from a VLF band close to DC to a SHF for satellite broadcasting and satellite communications (FM, televisions, radios, amateur radios, ship and airplane radio communications, mobile radio communications in automobiles, etc., BS and CS).

BACKGROUND TECHNIQUES

Various antennas including linear antennas are known conventionally. Any of these reception antennas has an operational impedance $R_o$, so that a feeder having a characteristic impedance $R_o$ equal to the operational impedance $R_o$ is connected to the antenna to lead received electric waves to a receiver.

However, since the real part of the operational impedance $R_o$ itself is a source of thermal noise, the received signal would be covered with the thermal noise if there is no reception field strength which exceeds the thermal noise. Thus the received signal is available even if it is amplified in the subsequent stages to whatever degree. Namely, there is a minimum limit to the reception field strength.

It is an object of the present invention to provide a small relatively wide-band active antenna which is capable of receiving in principle any small electric waves below the minimum limit to the reception field strength

DISCLOSURE OF THE INVENTION

An active antenna according to the present invention comprises a lumped constant element forming a reception part for electric waves, and a high input impedance voltage amplifier or a low input impedance (current) amplifier having input terminals connected to the corresponding ends of the lumped constant element directly or via leads very short compared to the wavelength of a received frequency and having an output terminal connected with a receiver, said amplifier including parallel connected amplifying elements.

Thus, the active antenna obtained is small and has superhigh sensitivity. When the inventive active antenna was used, the FM broadcasting from FM-Yokohama Broadcasting Station was received satisfactorily in a building at Akasaka, Minato-ku, Tokyo, with an amplification gain, for example of 20 dB, whereas when a conventional tuner having a 1.5 uV reception sensitivity and a 1 m-dipole antenna were used, the FM Broadcasting could not be received. Similarly, the inventive active antenna succeeded in the reception of the television broadcasting from Tama Television Station in the same building whereas a 32-element 16-dB gain UHF reception antenna could not receive it.

Since no reception current flows in the antenna elements of the inventive active antenna when it receives electric waves, no interference of second radiation occurs. In the conventional antenna, an electric current flows through the antenna elements to cause energy loss of spatial electric waves to thereby nullify electric waves in an adjacent room and hence disable the reception of electric waves by the antennas in the room whereas in the inventive active antenna no currents flows through the antenna elements, and no electric waves are led from the space to the receiver, so that the reception of electric waves by the antenna in the adjacent room is not be disabled.

According to the inventive active antenna, no parabolic antenna is required even in the BS reception, etc. If a high noise figure high amplification factor amplifier is developed, it can replace large-diameter parabolic antennas. Of course, if a parabolic antenna is attached to the inventive active antenna, its sensitivity is furthermore improved to thereby allow to reduce the diameter of the parabolic antenna.

The inventive active antenna has a relatively wide-band. According to the conventional antenna, a multi-ghost occurs in the TV reception due to reflection of electric waves by buildings, etc., so that there has been a difficulty in enjoying television broadcasting in a city while according to the inventive active antenna, it has been found that there are many ghost-free spots, for example, in a spherical space of a diameter of 20 cm even in a room. Thus, an unsolvable difficulty in enjoying the reception of TV broadcasting in the conventional television antenna is solved by the present invention.

BEST MOST FOR CARRYING OUT THE INVENTION

The present invention will now be described in more detail with reference to the accompanying drawings.

Generally, if capacitors and coils are ideal and have no resistant components, the real part of the impedance of the lumped constant elements of an antenna system except for amplifiers is zero and there are no sources of thermal noise, which means that the antenna receives electric waves with a 0 Ω equivalent resistance value or with an equivalent reactance (equivalently, an inductance (L) or equivalently capacitance (C) and the combination of them).

Thermal noise due to the input impedance of the amplifier is short-circuited by capacitance in a high frequency area and by inductance in a low frequency area and does not appear in the output of the amplifier.

In a particular reception frequency, a reactance is inserted in series with the antenna elements to cause series resonance with the reactance of the elements.

Thus, electric waves can be received with zero thermal noise in the antenna system to thereby increase the amplification factor of the amplifier and hence to enable reception of electric waves even if they are small to whatever extent. The lumped constant elements may include a linear conductor.

Figure 1:
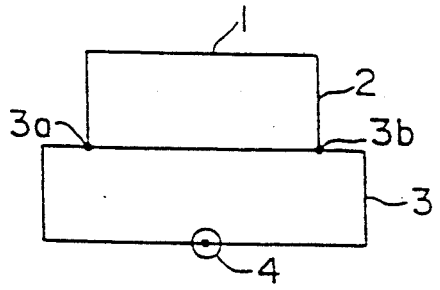
FIG. 1 illustrates an active antenna according to the present invention.

In the invention as shown in FIG. 1, a linear conductor antenna element 1 sufficiently short, for example, of a few centimeters, compared to the wavelength of a reception frequency is used. Both ends of the antenna element 1 are connected directly or via leads 2 having a very short length compared to the wavelength of the reception frequency to input terminals 3a and 3b of a high or low input impedance amplifier 3 the output terminal 4 of which is connected to a receiver (not shown).

Since the inventive active antenna has the above structure, the resistance components in the short antenna element 1 and leads 2 are substantially zero, few thermal noise occurs, and hence very slight electric waves can be received without being swallowed up by noise.

Figure 2:
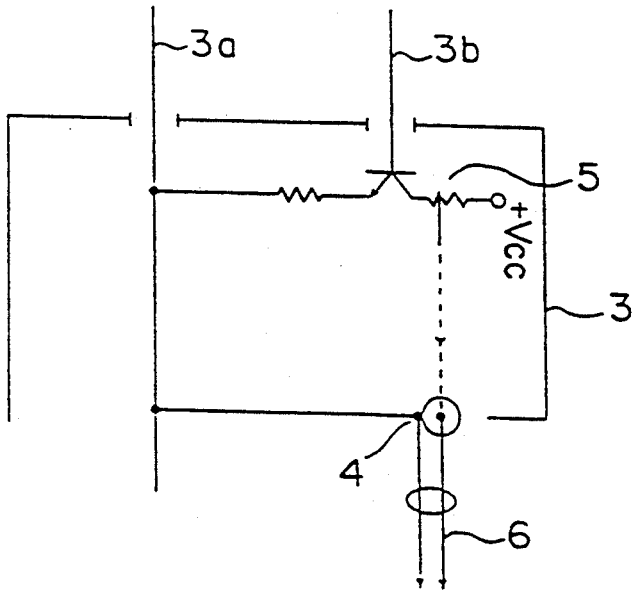
FIGS. 2 and 3 each is a circuit diagram of an amplifier in the antenna.

FIG. 2 illustrates a circuit diagram of an amplifier which is considered to be a high-input impedance amplifier 3 used in the inventive active antenna. Reference numeral 5 denotes a transistor; and 6, a coaxial cable. In such an amplifier, a jacket of the coaxial cable 6 is connected to ground and to one end of the antenna element 1 via one 3a of the input terminals to thereby constitute a dipole antenna. As the position of the coaxial cable 6 changes, for example, the state of electric wave reception by the antenna changes disadvantageously.

Figure 3:
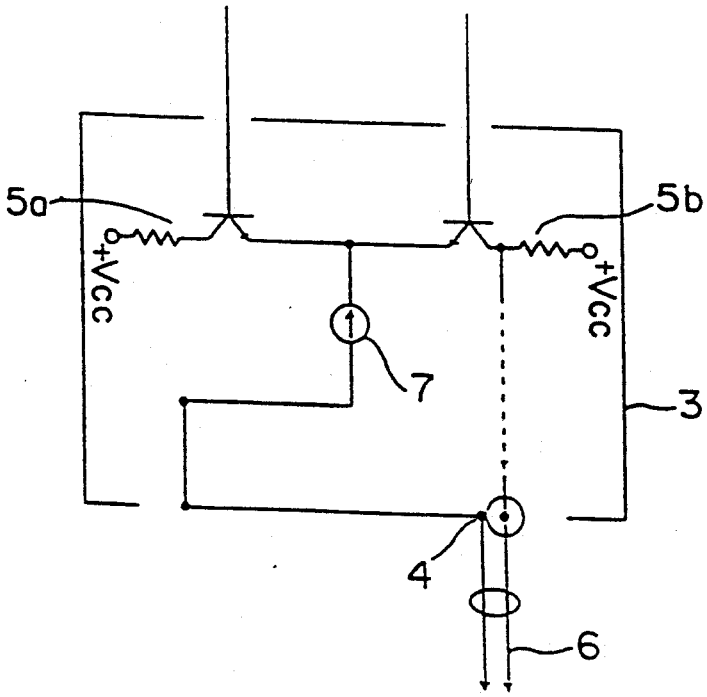

Therefore, as a preferred amplifier used in the inventive active antenna, a differential amplifier using a pair of transistor amplifying elements 5a and 5b which may be a transistor, for example, is conceivable, as shown in FIG. 3. By parallel connection of N such amplifying elements, the signal component is multiplied by a factor of N and the noise in the amplifying elements is multiplied by a factor of $\sqrt{N}$ (rms value), so that the noise component in the amplifying elements is nullified relatively (zero-noise figure amplifying elements are provided).

Therefore, noise in the amplifying section is nullified.

Reference numeral 7 denotes a constant current source.

By use of this amplifier, the grounding line of the amplifier and the jacket of the coaxial cable are completely separated from the antenna elements, so that the formation of a dipole antenna is prevented as mentioned above.

Figure 4:
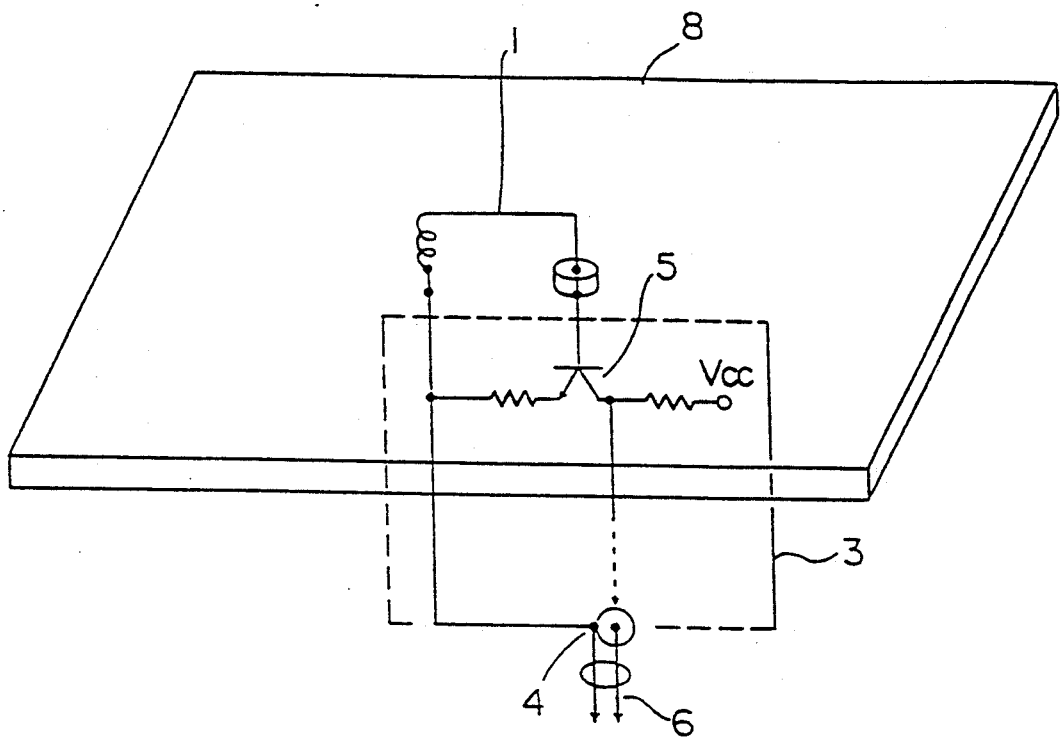
FIG. 4 illustrates another embodiment of the amplifier.
Figure 5:
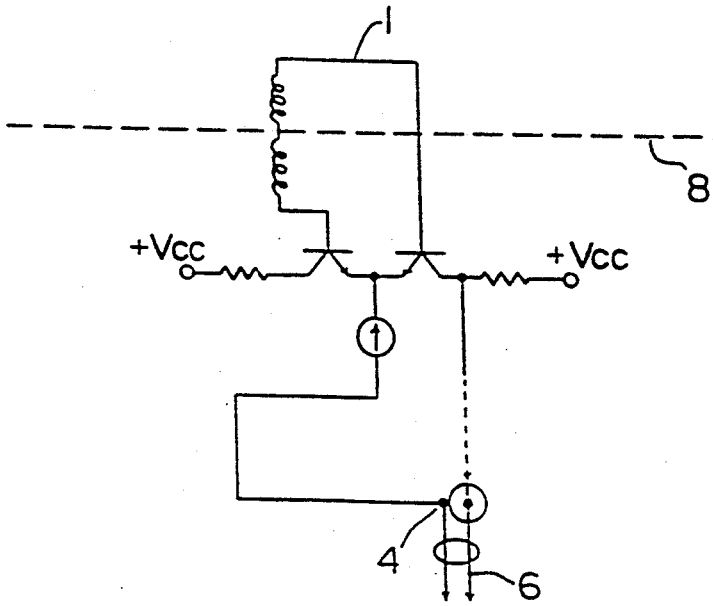
FIG. 5 is a circuit diagram of an equivalent circuit of the last-mentioned amplifier.

FIG. 4 illustrates an example in which the antenna element 1 and the amplifier 3 of FIG. 2 are isolated from each other by a shield plate 8. In the example, by the mirror effect of the shield plate the resulting equivalent circuit is as shown in FIG. 5 to thereby produce effects similar to those described with respect to the example of FIG. 3. By parallel connection of N such amplifying elements, the signal component is multiplied by a factor of N and the noise in the amplifying elements is multiplied by a factor of $\sqrt{N}$ (rms value), so that the noise component in the amplifying elements is nullified relatively (zero-noise figure amplifying elements are provided).

Figure 6:
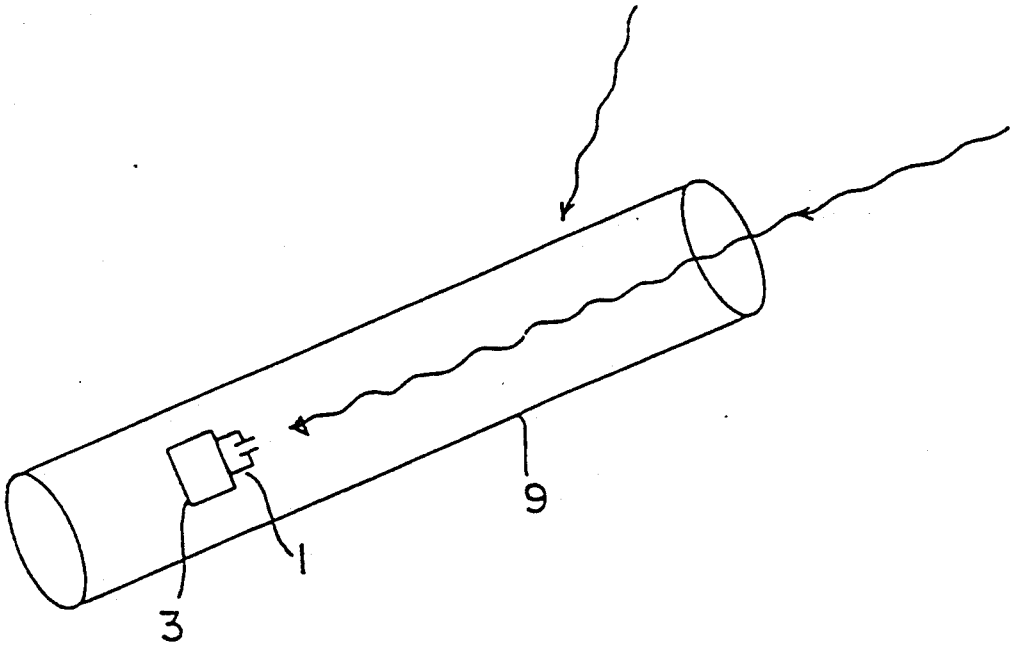

FIG. 6 illustrates an example in which the inventive active antenna is disposed in one end of an electric wave absorber, for example, of a ferrite sleeve 9 having a length of several meters, and in which electric waves are led from the other end of the absorber. According to the example, the directionality of the antenna is greatly improved.

Figure 7:
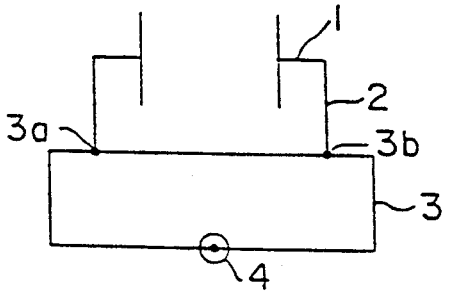
FIGS. 6–9 each illustrate another embodiment of the active antenna of the present invention.
Figure 8:
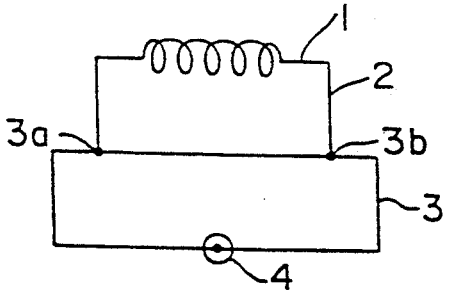
Figure 9:
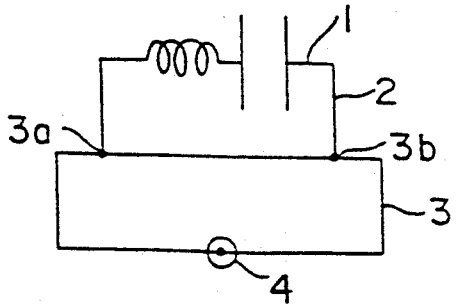

FIG. 7 shows an example in which a capacitor-like antenna element 1 in the inventive active antenna which includes a pair of 8 cm-square conductive plates 1a and 1b spaced 10 cm. As shown in FIG. 8, it may be a coil-like element of 10 turns and of a diameter and a length each of several centimeters. In addition, as shown in FIG. 9, a series connection of a capacitor-like element and a coil-like element may be used.

The input reactive part of the amplifier can be canceled by parallel resonance due to insertion of an equivalent reactance in parallel with the input terminals of the amplifier to thereby realize an increased or decreased impedance.

When the input of the amplifier is the capacity (C), the input impedance is decreased, whereas this can be canceled by parallel resonance due to insertion of the inductance (L) in paralleled with parallel with the input terminals of the INDUSTRIAL APPLICABILITY As described above, the inventive active antenna is suitable for a small relatively wide band superhigh sensitivity active antenna usable in a wide range of applications ranging from a VLF band close to DC to a SHF for satellite broadcasting and satellite communications (FM, television, radios, amateur radios, ship and airplane radio communications, mobile radio communications, in automobiles, etc., BS and CS) and capable of receiving any weak electric waves in principle.

I claim:

1. An active receiving antenna, comprising:

a lumped reactive element receiving an electromagnetic signal of a predetermined wavelength and supplying a corresponding received radio frequency signal;

transmission line means connected to said lumped reactive element for receiving said received radio frequency signal, said transmission line means having an electrical length substantially shorter than said predetermined wavelength; and a radio frequency amplifier connected to said transmission line means for receiving and amplifying said radio frequency signal, said radio frequency amplifier including (i) a pair of bipolar transistors having base terminals connected to said transmission line means for receiving said radio frequency signal, commonly connected emitter terminals, and collector terminals for receiving a power supply potential, (ii) a current source supplying a constant current to said commonly connected emitter terminals of said pair of bipolar transistors, and (iii) an output node connected to one of said collector terminals of one of said bipolar transistors for supplying an amplified electric RF signal.

2. The active receiving antenna of claim 1, wherein said lumped reactive element comprises a capacitor.

3. The active receiving antenna of claim 1, wherein said lumped reactive element comprises a coil.

4. The active receiving antenna of claim 1, wherein said lumped reactive element comprises a series connection of a capacitor and a coil.

5. The active receiving antenna of claim 1, further comprising a substantially planar shield plate, said lumped reactive element and said amplifier located on opposite sides of said shield plate, said transmission means passing through said shield plate connecting said lumped reactive element to said amplifier.

6. The active receiving antenna of claim 1, further comprising a substantially tubular ferrite sleeve having a length of several meters, said lumped reactive element and said amplifier positioned within said sleeve.

7. The active receiving antenna of claim 6, wherein said lumped reactive element comprises a capacitor.

* * * * *